US010874924B2

(12) United States Patent
Walton

(10) Patent No.: US 10,874,924 B2
(45) Date of Patent: Dec. 29, 2020

(54) SWING PLANE TEE APPARATUS AND METHOD

(71) Applicant: THE BOARD OF REGENTS FOR OKLAHOMA STATE UNIVERSITY, Stillwater, OK (US)

(72) Inventor: Robert James Walton, Stillwater, OK (US)

(73) Assignee: THE BOARD OF REGENTS FOR OKLAHOMA STATE UNIVERSITY, Stillwater, OK (US)

( * ) Notice: Subject to any disclaimer, the term of this patent is extended or adjusted under 35 U.S.C. 154(b) by 0 days.

(21) Appl. No.: 16/565,763

(22) Filed: Sep. 10, 2019

(65) Prior Publication Data

US 2020/0078651 A1 Mar. 12, 2020

Related U.S. Application Data

(60) Provisional application No. 62/729,028, filed on Sep. 10, 2018.

(51) Int. Cl.

| | |
|---|---|
| ***A63B 69/00*** | (2006.01) |
| ***A63B 71/02*** | (2006.01) |
| *A63B 69/40* | (2006.01) |
| *A63B 102/18* | (2015.01) |

(52) U.S. Cl.

CPC ..... *A63B 69/0075* (2013.01); *A63B 69/0002* (2013.01); *A63B 71/023* (2013.01); *A63B 2069/0008* (2013.01); *A63B 2069/401* (2013.01); *A63B 2102/18* (2015.10)

(58) Field of Classification Search

CPC ..... A63B 69/0075; A63B 69/0002; A63B 71/023; A63B 2069/0008; A63B 2069/401; A63B 2102/18

USPC ..... 473/417, 422, 423

See application file for complete search history.

(56) References Cited

U.S. PATENT DOCUMENTS

| | | | | | |
|---|---|---|---|---|---|
| 4,979,741 | A * | 12/1990 | Butcher | A63B 69/0002 | 473/417 |
| 5,897,444 | A * | 4/1999 | Hellyer | A63B 69/0075 | 473/417 |
| 2004/0266562 | A1* | 12/2004 | Gowan | A63B 69/407 | 473/416 |
| 2007/0049426 | A1* | 3/2007 | Huang | A63B 69/0002 | 473/417 |
| 2007/0167261 | A1* | 7/2007 | Lortscher | A63B 69/0002 | 473/417 |
| 2012/0004054 | A1* | 1/2012 | McKendrick | A63B 69/0075 | 473/418 |

* cited by examiner

*Primary Examiner* — Nini F Legesse

(74) *Attorney, Agent, or Firm* — Fellers, Snider, Blankenship, Bailey & Tippens, P.C.; Terry L. Watt

(57) ABSTRACT

There is provided herein an apparatus and method for teaching a baseball participant how best to swing a bat in order to urge a struck ball to fly in a particular direction. More particularly, various embodiments provide immediate feedback to the batter make proper corrections for a properly hit baseball by forcing the batter to swing the bat at a predetermined angle appropriate for a desired ball trajectory.

14 Claims, 6 Drawing Sheets

SWING PLANE TEE APPARATUS AND METHOD

CROSS REFERENCE TO RELATED APPLICATIONS

This application claims the benefit of U.S. Provisional Patent Application Ser. No. 62/729,028 filed on Sep. 10, 2018, and incorporates said provisional application by reference into this document as if fully set out at this point.

TECHNICAL FIELD

This disclosure relates generally to baseball training devices and, more specifically, to systems and methods of training a batter to properly swing a bat.

BACKGROUND

Needless to say, a fundamental skill in the game of baseball is an ability to hit the ball. For beginners, being able to make any sort of contact with a thrown ball is sufficient. However, more skilled players not only want to be able to hit the ball but also to direct the ball to a particular part of the field. Some players learn this skill by trial-and-error. However, there are known techniques for so directing the ball which can be taught and learned.

As might be expected, a skill this important to the play of the game has been subject to a large number of inventive efforts and there are various devices on the market that seek to help a player better understand and learn how the bat and/or swing angle can be adjusted to influence the resulting ball trajectory. However, all of the prior art approaches have various problems.

Thus, what is needed is an improved apparatus to assist a ball player learn how to hit the ball in a particular direction by adjusting the angle of the swung bat.

Before proceeding to a description of the present invention, however, it should be noted and remembered that the description of the invention which follows, together with the accompanying drawings, should not be construed as limiting the invention to the examples (or embodiments) shown and described. This is so because those skilled in the art to which the invention pertains will be able to devise other forms of this invention within the ambit of the appended claims.

SUMMARY OF THE INVENTION

There is provided herein an apparatus and method for teaching a baseball participant how best to swing a bat in order to urge the struck ball to fly in a particular direction. More particularly, various embodiments taught herein provide immediate feedback to the batter to assist him or her in adjusting the angle of the bat during a swing so that the stuck ball is launched according to a desired trajectory. No other known product corrects the swing plane and swing path of the bat so that the ball may be hit correctly.

In one embodiment of the instant batting trainer, a generally planar surface is provided that is adjustable at least with respect to its height and its tilt angle. Projecting above the surface is a tee on which a baseball or other ball (e.g., a softball) may be placed so that it may be struck with a bat. After the ball is so-placed, a batter then positions him- or herself proximate to the trainer, thereby allowing the height to be adjusted, if necessary, to reflect the batter's particular physiology. Finally, the angle of the planar surface can be adjusted at the angle at which the coach desires the batter to swing the bat. A ball is placed atop the tee on its upper terminus. The batter is then instructed to swing at the ball while maintaining the bat at an angle that is parallel to the angle of the planar surface. Failure to maintain the requested angle will be immediately obvious to the batter, as the bat will contact the planar surface.

The foregoing has outlined in broad terms some of the more important features of the invention disclosed herein so that the detailed description that follows may be more clearly understood, and so that the contribution of the instant inventors to the art may be better appreciated. The instant invention is not to be limited in its application to the details of the construction and to the arrangements of the components set forth in the following description or illustrated in the drawings. Rather, the invention is capable of other embodiments and of being practiced and carried out in various other ways not specifically enumerated herein. Finally, it should be understood that the phraseology and terminology employed herein are for the purpose of description and should not be regarded as limiting, unless the specification specifically so limits the invention.

BRIEF DESCRIPTION OF THE DRAWINGS

These and further aspects of the invention are described in detail in the following examples and accompanying drawings.

DETAILED DESCRIPTION

Figure 1:
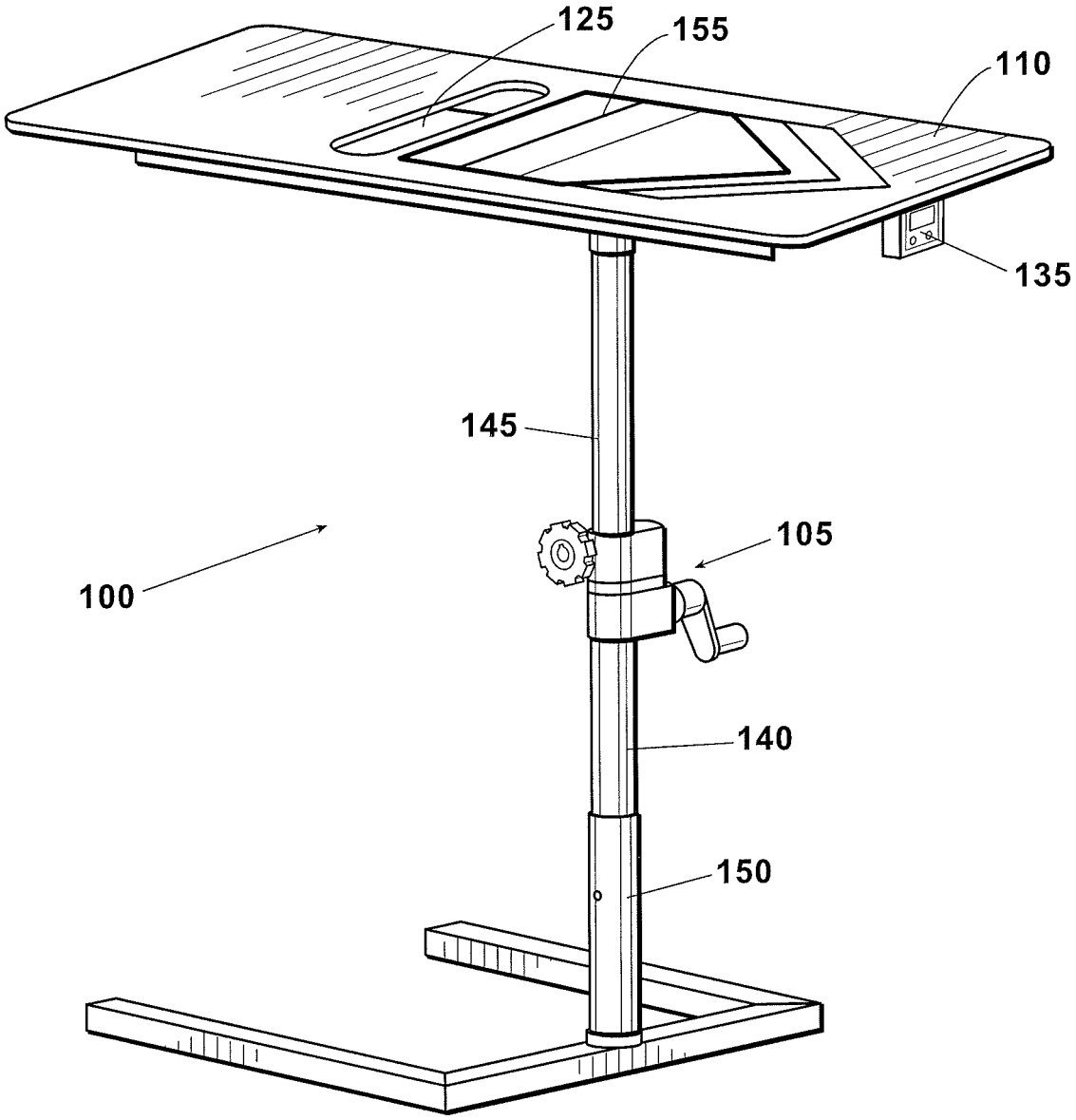
FIG. 1 illustrates an embodiment of the instant batter swing trainer in which the planar swing surface 110 has been elevated.

While this invention is susceptible of embodiment in many different forms, there is shown in the drawings, and will herein be described hereinafter in detail, some specific embodiments of the instant invention. It should be understood, however, that the present disclosure is to be considered an exemplification of the principles of the invention and is not intended to limit the invention to the specific embodiments or algorithms so described.

According to an embodiment, there is provided a batting or swing training device and method that is designed to teach a batter how to properly angle a bat in order to direct a thrown baseball in a desired direction.

Figure 2:
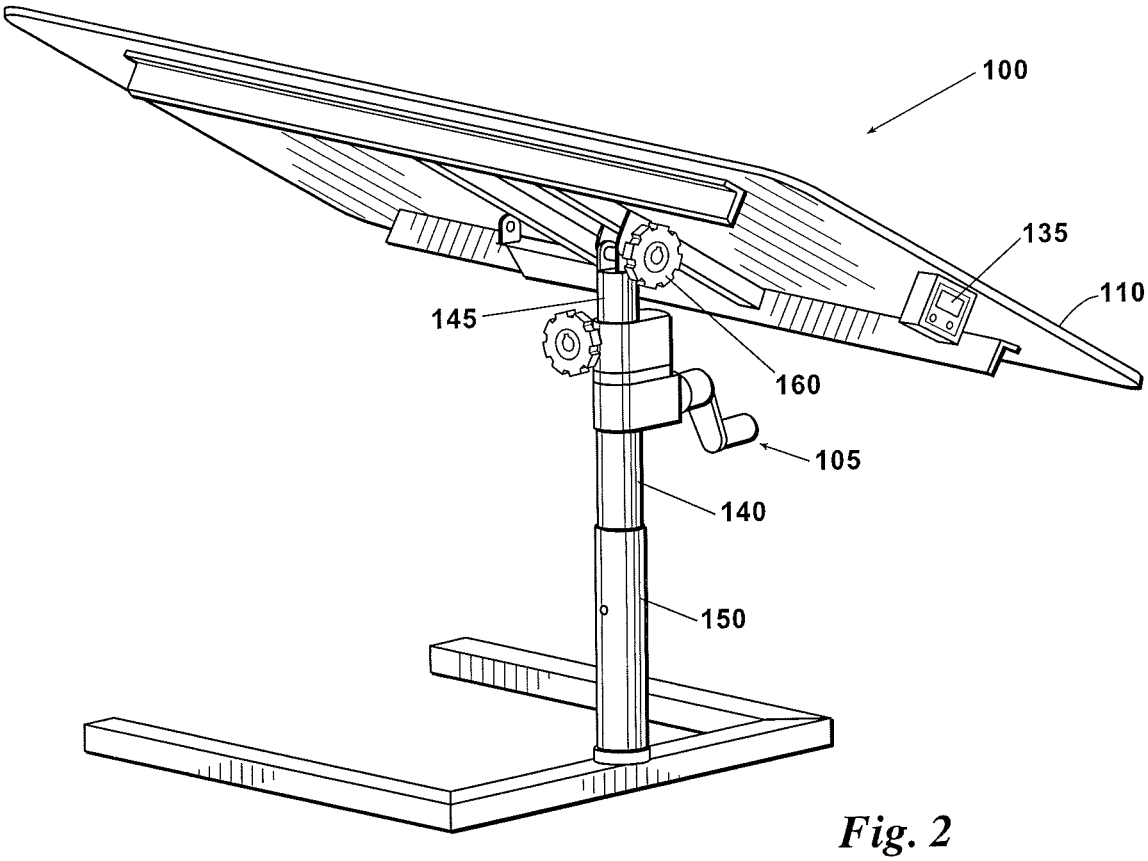
FIG. 2 illustrates an underside view of the embodiment of FIG. 1, where the planar swing surface 110 has been lowered as compared with the embodiment of FIG. 1.

The swing trainer 100 of FIGS. 1 and 2 generally comprises a planar surface 110 that can be tilted at different angles and that contains at least one aperture 125 therethrough. In some embodiments, the aperture 125 might be circular in shape. In other instances, it might be elongated in a direction away from the location where the batter stands as is generally indicated in FIG. 1. This configuration (i.e., FIG. 1) might be particularly useful for those embodiments where it is desired to move the position of the ball toward or away from the batter to simulate an inside or outside pitch. Of course, the size, shape, and orientation of the aperture 125 is not critical and those of ordinary skill in the art will recognize how it might be adapted to suit different configurations of the instant invention and to simulate different thrown ball scenarios.

In some embodiments the planar surface 110 will be rotatably mounted atop extension member 145 so that it can be tilted as much as 75° in either direction, where the amount of rotation is measured with respect to generally horizontal surface on which the trainer 100 is placed. This allows the instant trainer 100 to be readily adjusted to accommodate both left- and right-handed batters. In some embodiments the angle of tilt will be measured by an inclinometer 135, preferably a digital inclinometer, that is affixed to the underside of the planar surface 110.

According to the embodiment of FIGS. 1 and 2, the planar surface 110 is adjustable in height to accommodate batters of different heights. In some embodiments the adjustment might be made using a crank and gear mechanism 105 which is designed to extend the extension member 145 in order to elevate the planar surface 110. In some embodiments the amount of adjustment in the height that is provided by the crank 105 might be as much as 15", although those of ordinary skill in the art will recognize that the amount of adjustment that is provided is a design decision that could be readily altered to suit the needs of a particular group of batters, e.g., elementary school batters could need a different range of elevation levels than, say, a group of college age batters. Some embodiments will utilize a configuration where an upper support member 140 is slideably nested within the base support member 150. Some embodiments will allow adjustment via a series of holes in the upper support member 140 and a compatible hole or holes in the base support member 150 sized to accommodate an inserted pin. This arrangement could provide additional height adjustment (e.g., 6") at intervals corresponding to the spacing of the holes in the support member. Other arrangements are clearly possible.

Also present in the embodiment of FIGS. 1 and 2 are a plurality of stylized drawings 155 on the upper face of the planar surface 110 that generally represent a home plate of the sort traditionally used in games such as softball and baseball. One use for these drawings 155 is to provide visual feedback to the batter to assist him or her in assuming a preferred position with respect to home plate in advance of swinging at the ball. The multiple home plate drawings 155 are provided so that, among others, the distance between the ball and the plate can be systematically varied by moving the batter closer or further away from the ball so that the point of contact with the ball is a greater or lesser distance ahead of the representation of home plate 155. Of course, those of ordinary skill in the art will recognize that the position an individual takes in the batter's box with respect to home plate is an important component of a hitter's batting style and strategy. Various embodiments allow the batter to take positions forward or backward in the batter's box with respect to the representations of home plate 155 that are imprinted on the planar surface 110, and also nearer to and farther away from the plate 155 to simulate swinging at inside and outside pitches.

Figure 3:
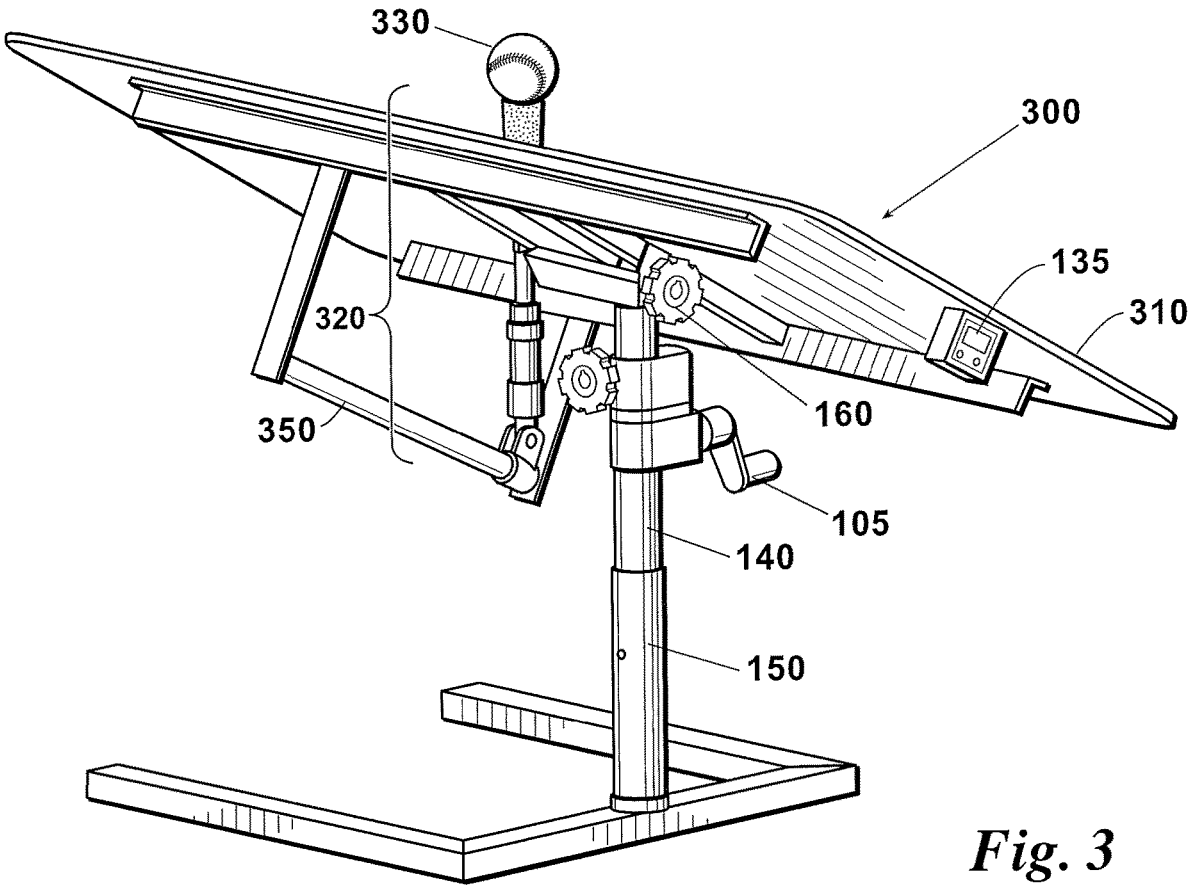
FIG. 3 contains a variation in which an adjustable tee assembly 320 has been provided, wherein the tee assembly in this embodiment is adjustable vertically and horizontally as well as rotatably with respect to the support bar 350.
Figure 4:
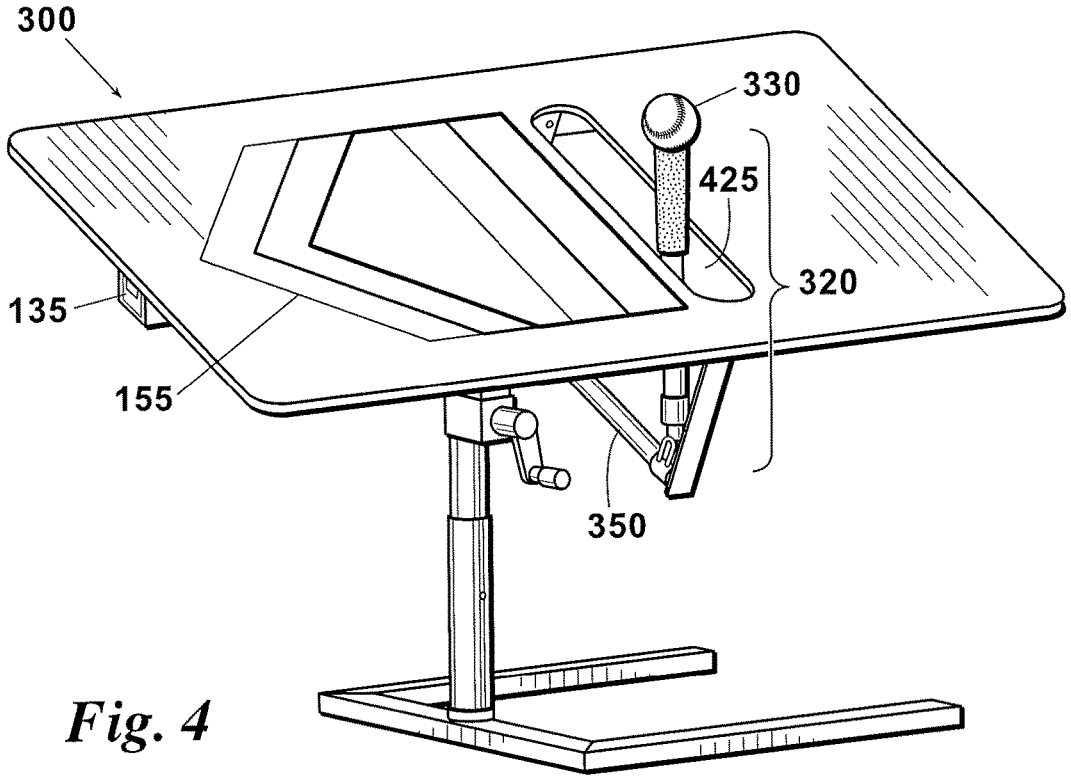
FIG. 4 contains another view of the embodiment of FIG. 3.

According to the embodiments of FIGS. 3 and 4, a tee assembly 320 is positionable to be inserted through the planar surface aperture 425 and is configured to hold a ball 330 (e.g., a baseball) on its upper terminus so that the ball is elevated above the planar surface 310 while a batter swings at it. The tee assembly 325 could be constructed with nested tubing that allows the elevation of the ball 330 to be adjustable (e.g., using a compression ring arrangement) with respect to the planar surface 310 to suit different batters or to simulate different pitch heights. The tee assembly 320 might be made of metal, plastic, PVC tubing, etc. In some embodiments the assembly 320 might be pivotably attached to lateral support member 350 so that the angle of the tee 330 with respect to the lateral support member 350 might be adjusted to accommodate different orientations of the planar surface 425. Additionally, certain embodiments will allow the tee assembly 320 to be movable along the length of the lateral support member 350 so that the distance from the batter can be varied to simulate inside and outside pitches.

Figure 5:
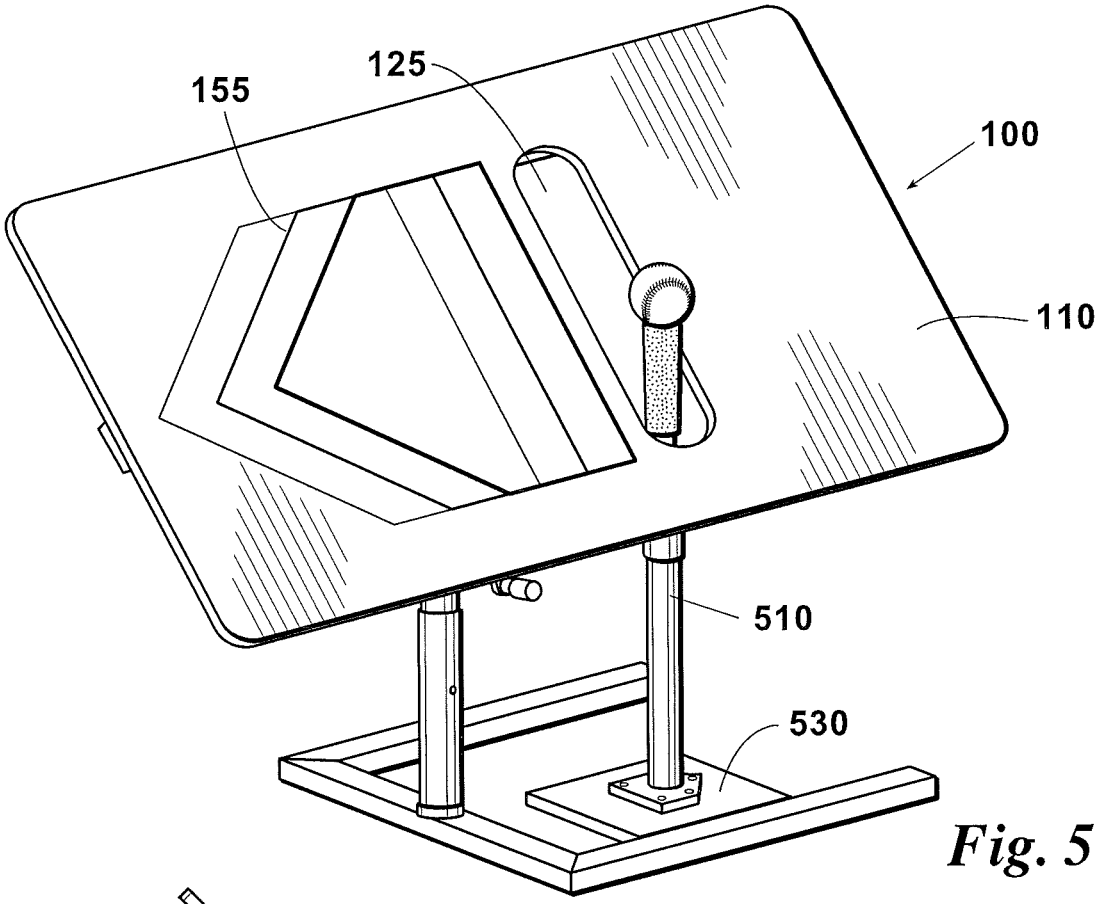
FIG. 5 contains an illustration of an embodiment which utilizes a free-standing tee assembly 510.
Figure 6:
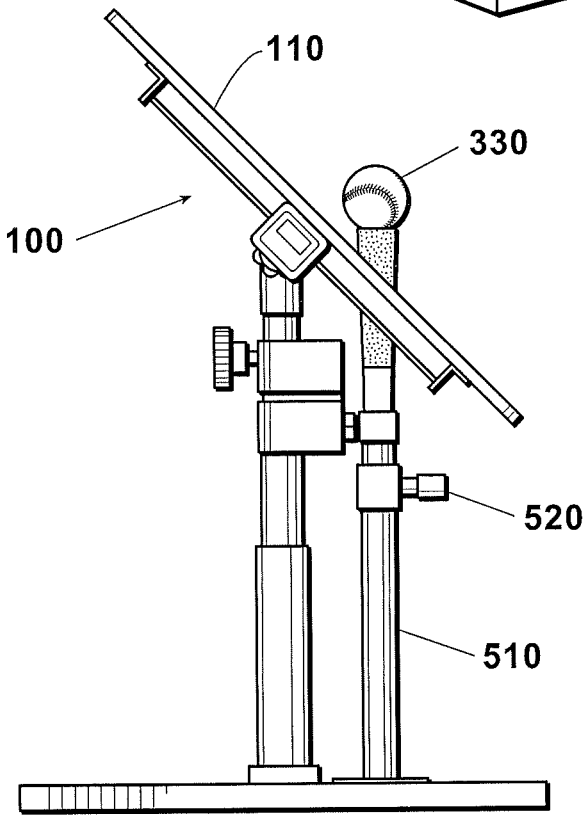
FIG. 6 contains another view of the embodiment of FIG. 5.

FIGS. 5 and 6 illustrate still another embodiment. In this case the tee assembly 510 is configured to be a free-standing component of the instant swing training device 100 and preferably is configured to be supported by a base 530 that is positionable to be underneath the planar surface in a way that allows the upper terminus of the tee assembly 510 to extend through the aperture 125 so that a ball can be placed atop it. In the embodiment of FIGS. 5 and 6, the distance that tee assembly 510 extends about the planar surface 110 can be adjusted by a crank mechanism of the same sort as that discussed in connection with FIGS. 1 and 2. Alternative arrangements for modifying the height of the ball are certainly possible and well within the ability of one of ordinary skill in the art to devise.

Figure 7:
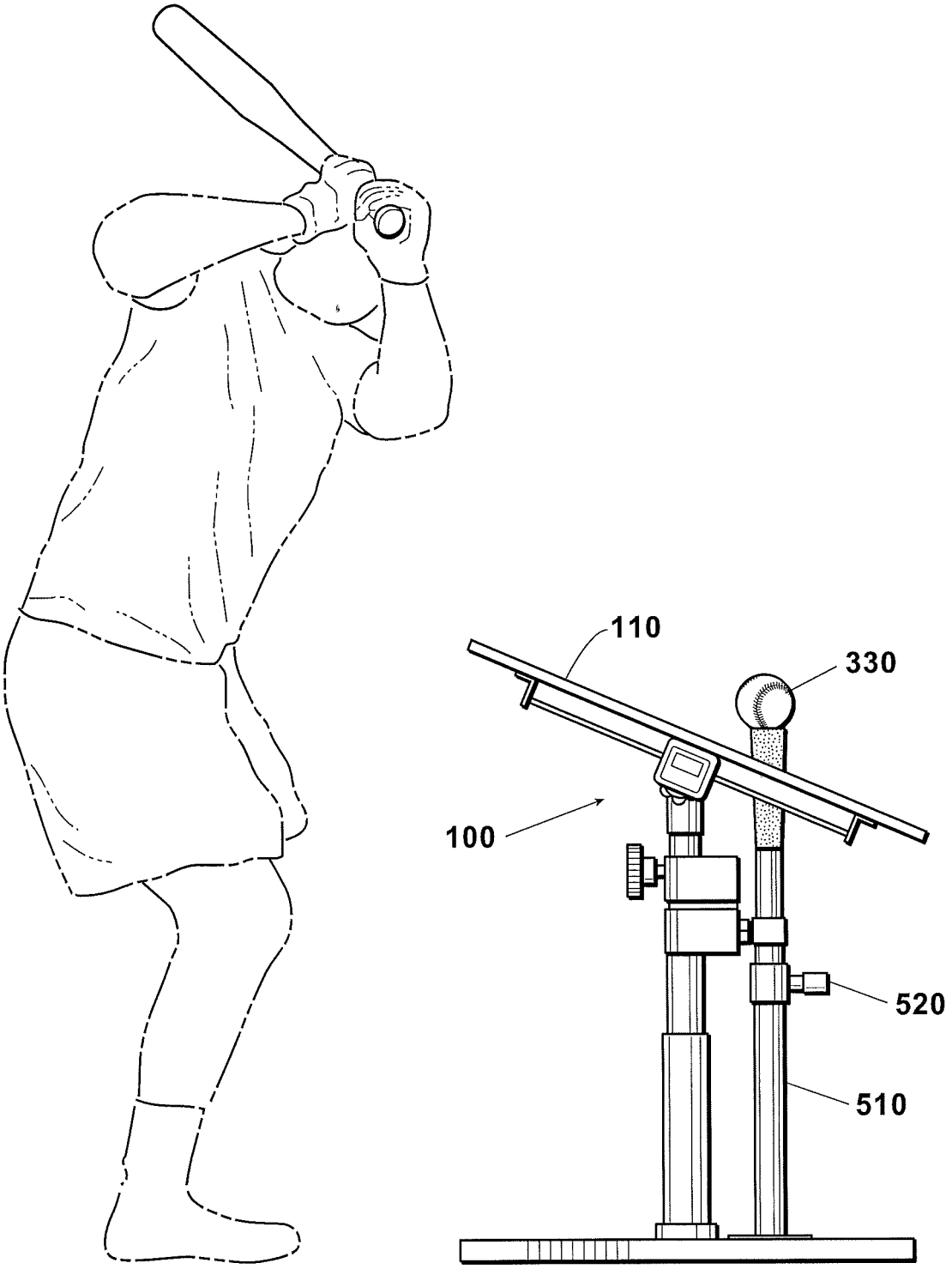
FIG. 7 contains an illustration of how an embodiment might be utilized in practice. In this figure the batter is preparing to hit the ball that is resting atop the tee assembly.
Figure 8:
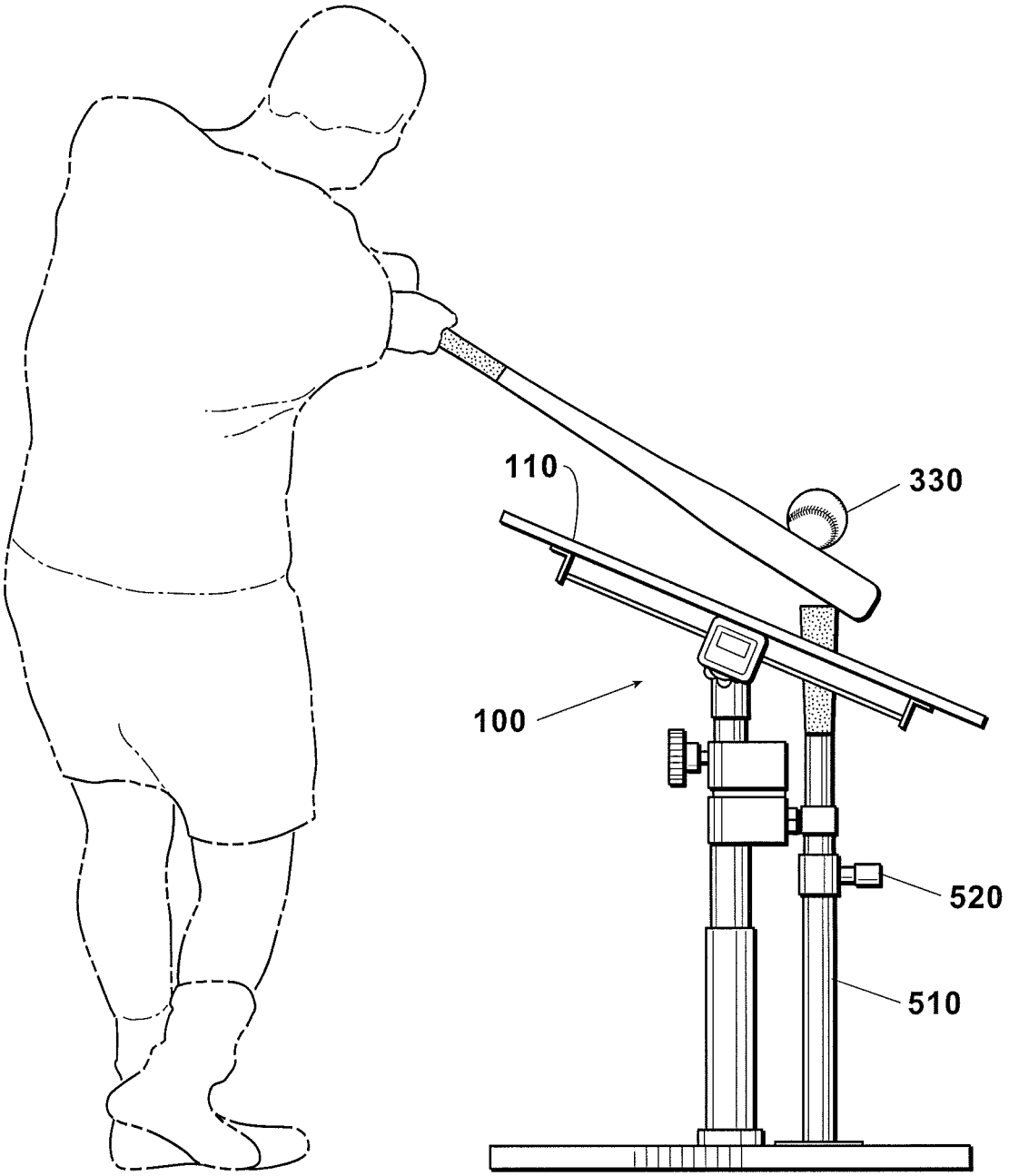
FIG. 8 contains an illustration of the embodiment of FIG. 7 at the point in time where the batter's swing contacts the ball.

In operation and as is generally indicated in FIGS. 7 and 8, in one embodiment the batter will be positioned and the instant device adjusted in height to accommodate that individual. A hitting direction will be determined (e.g., to left or right field) and, depending on whether the batter is left- or right-handed, the planar surface 110 will be tilted to provide a guide to the batter when s/he is hitting the ball. A ball will be placed on the tee assembly 520 that extends upward through the planar surface 110 and the batter will be encouraged to hit it by swinging the bat at an angle that is roughly parallel to the angle of the planar surface 110. Obviously, the planar surface 110 will operate to enforce the choice of swing angle both visually, by providing a clear guide, and physically, by causing the bat to recoil if it is swung at an angle that is incompatible with the current setting and the bat encounters the planar surface 110. Thus, a batter who contacts the ball at an appropriate angle will avoid contact with the surface 110 which will teach him or her the angle of the bat that is most appropriate to use in a given batting scenario.

As a specific example, a right-handed batter wanting to drive the ball to right field would set the angle of the planar surface 110 at an angle of between about 12-25 degrees as measured from the horizontal. As a general matter, the numerical value of the angle of the planar surface 110 should not normally be smaller than about 12 degrees or higher than about 25 degrees, although in certain cases it certainly might be beneficial to adjust it to a greater or lesser angle of inclination. A left-handed batter who desires to hit to left field would use the same angular setting, 12-25 degrees, although measured from the opposite side of the device 100.

As another example, a right-handed batter wanting to pull the ball to the left field would set the angle of the planar surface 110 to about 25 to 40 degrees with respect to horizontal. The same would apply for a left-handed batter wanting to hit the ball to right field.

As indicated previously, the height of the instant embodiment 100 can be raised or lowered to adjust it to the height of a batter. From there the planar surface 100 can be elevated 5-10 inches for an outside pitch and lowered 5-10 inches for an inside pitch.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

For purposes of the instant disclosure, the term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. Terms of approximation (e.g., "about", "substantially", "approximately", etc.) should be interpreted according to their ordinary and customary meanings as used in the associated art unless indicated otherwise. Absent a specific definition and absent ordinary and customary usage in the associated art, such terms should be interpreted to be ±10% of the base value.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Still further, additional aspects of the instant invention may be found in one or more appendices attached hereto and/or filed herewith, the disclosures of which are incorporated herein by reference as if fully set out at this point.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A device for training a batter to hit a ball, comprising:

(a) a planar surface having at least one aperture therethrough, said planar surface being rotatably mounted on a base, wherein said planar surface can be rotatably adjusted to have a predetermined tilt angle between 12° and 75° with respect to a horizontal surface on which the base is placed; and (b) a ball tee extending upward through said aperture, said ball tee at least for receiving the ball thereon.

2. A device for training a batter to hit a ball according to claim 1, wherein said ball tee is slideably and rotatably mounted to an underside of said planar surface.

3. A device for training a batter to hit a ball according to claim 2, wherein said ball tee is adjustable in length to allow a height of the ball above said planar surface to be increased or decreased.

4. A device for training a batter to hit a ball according to claim 2, wherein said ball tee is adjustable in height to allow a height of the ball above said planar surface to be varied.

5. A device for training a batter to hit a ball according to claim 1, wherein said ball tee is free-standing and wherein said ball tee is supported by a base positionable to be underneath said planar surface.

6. A device for training a batter to hit a ball according to claim 1, wherein said planar surface has one or more indicia representative of a home plate imprinted thereon.

7. A method of training a batter to hit a ball, wherein is provided the apparatus of claim 6, comprising the steps of:

(a) determining a desired field to hit;

(b) using said desired field to determine a desired training angle of said planar surface;

(c) adjusting an angle of said planar surface to at least approximately equal said desired training angle;

(d) positioning the ball atop said ball tee;

(e) positioning the batter with respect to one of said indicia representative of a home plate; and (f) after the angle of said planar surface has been adjusted to at least approximately equal said desired training angle, allowing the batter to hit the ball with a bat without contacting said planar surface, thereby training the batter to hit the ball to the desired field.

8. A device for training a batter to hit a ball according to claim 1, wherein said aperture is circular.

9. A method of training a batter to hit a ball, wherein is provided the apparatus of claim 1, comprising the steps of:

(a) determining a batter's desired field to hit;

(b) determining whether the batter is a right-handed batter or a left-handed batter;

(c) using said desired field to hit and said determined right or left handedness of the batter to determine a training angle of said planar surface;

(d) rotatably adjusting an angle of said planar surface to at least approximately equal said training angle;

(e) positioning the ball atop said ball tee;

(f) positioning the batter with respect to the ball; and (g) after said planar surface has been rotatably adjusted to at least approximately equal said training angle, allowing the batter to hit the ball with a bat without contacting said planar surface, thereby training the batter to hit the ball to the desired field.

10. A method according to claim 9, wherein step (c) comprises the steps of:

(c1) if the determined handedness of the batter is right-handed and the desired field to hit is right field, determining that the training angle should be between 12 and 25 degrees;

(c2) if the determined handedness of the batter is left-handed and the desired field to hit is left field, determining that the training angle should be between 12 and 25 degrees;

(c3) if the determined handedness of the batter is right-handed and the desired field to hit is left field, determining that the training angle should be between 25 and 40 degrees; and (c4) if the determined handedness of the batter is left-handed and the desired field to hit is right field, determining that the training angle surface should be between 25 and 40 degrees.

11. A device for training a batter to hit a ball, comprising:

(a) a planar surface having at least one aperture elongated in a direction away from the batter therethrough, said planar surface being rotatably mounted on a base and rotatably adjustable to have a tilt angle between 12° and 70'; and (b) a ball tee extending upward through said aperture, said ball tee at least for receiving the ball thereon and said ball tee being adjustable to a plurality of different heights above said planar surface.

12. A device for training a batter to hit a ball according to claim 11, wherein said ball tee is movable laterally within said aperture toward and away from the batter.

13. A device for training a batter to hit a ball according to claim 12, wherein said ball tee is movably mounted on a lateral support member affixed to an underside of said planar surface.

14. A method of training a batter to hit a ball, wherein is provided (i) a planar surface having at least one aperture therethrough, said planar surface being rotatably mounted on a base; and (ii) a ball tee extending upward through said aperture, said ball tee at least for receiving the ball thereon, said method comprising the steps of (a) determining a desired field for the batter to hit;

(b) using said desired field to determine a training angle range of said planar surface, wherein (b1) if the batter is a right-handed batter and the desired field to hit is right field, determining said training angle range is between 12 and 25 degrees;

(b2) if the batter is a left-handed batter and the desired field to hit is left field, determining that said training angle range is between 12 and 25 degrees;

(b3) if the batter is a right-handed batter and the desired field to hit is left field, determining that said training angle range is between 25 and 40 degrees; and (b4) if the batter is a left-handed batter and the desired field to hit is right field, determining that said training angle range is between 25 and 40 degrees; and (c) rotatably adjusting an angle of said planar surface to a batting angle within said training angle range;

(d) positioning the ball atop said ball tee;

(e) positioning the batter with respect to the ball; and (f) after said angle of said planar surface has been rotatably adjusted to the batting angle, allowing the batter to hit the ball with a bat without contacting said planar surface, thereby training the batter to hit the ball to the desired field.

* * * * *